US012329345B2

(12) United States Patent
Burggraf et al.

(10) Patent No.: US 12,329,345 B2
(45) Date of Patent: Jun. 17, 2025

(54) HOUSEHOLD DISHWASHER HAVING AT LEAST ONE AIR OUTLET

(71) Applicant: BSH Hausgeräte GmbH, Munich (DE)

(72) Inventors: Thomas Burggraf, Dillingen (DE); Xabier Sagües García, Pamplona (ES); Yongchao Tian, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 212 days.

(21) Appl. No.: 18/021,836

(22) PCT Filed: Sep. 15, 2021

(86) PCT No.: PCT/EP2021/075283
§ 371 (c)(1),
(2) Date: Feb. 17, 2023

(87) PCT Pub. No.: WO2022/069222
PCT Pub. Date: Apr. 7, 2022

(65) Prior Publication Data

US 2023/0225582 A1 Jul. 20, 2023

(30) Foreign Application Priority Data

Sep. 30, 2020 (CN) ..... 202011064088.5

(51) Int. Cl.
*A47L 15/48* (2006.01)
*A47L 15/42* (2006.01)

(52) U.S. Cl.
CPC ..... *A47L 15/488* (2013.01); *A47L 15/4251* (2013.01); *A47L 15/486* (2013.01); *A47L 2401/19* (2013.01); *A47L 2501/10* (2013.01); *A47L 2501/12* (2013.01)

(58) Field of Classification Search
CPC ..... A47L 15/00–508
See application file for complete search history.

(56) References Cited

U.S. PATENT DOCUMENTS

| | | | |
|---|---|---|---|
| 4,179,821 | A | 12/1979 | Herbst |
| 5,881,746 | A | 3/1999 | Buser |
| 8,313,583 | B2 | 11/2012 | May |
| 9,888,829 | B1 | 2/2018 | Bongivengo |
| 10,024,561 | B2 | 7/2018 | Olson |
| 2010/0043250 | A1 | 2/2010 | Berends |

(Continued)

FOREIGN PATENT DOCUMENTS

| | | |
|---|---|---|
| DE | 29601313 U1 | 6/1996 |
| DE | 19604370 A1 | 6/1997 |

(Continued)

OTHER PUBLICATIONS

KR-2013070278-A Machine Translation (Year: 2013).*
International Search Report PCT/EP2021/075283 dated Dec. 10, 2021.

*Primary Examiner* — Spencer E. Bell
(74) *Attorney, Agent, or Firm* — Michael E. Tschupp; Andre Pallapies; Brandon G. Braun

(57) ABSTRACT

A household dishwasher includes a dishwasher cavity for processing items to be washed, and an air outlet designed to blow out dishwasher interior air of the dishwasher cavity. The air outlet is arranged in a lower quarter of a height of the household dishwasher and extends as a slot outlet over at least half of a width of the household dishwasher.

21 Claims, 2 Drawing Sheets

(56) References Cited

U.S. PATENT DOCUMENTS

| | | | | |
|---|---|---|---|---|
| 2010/0083991 | A1* | 4/2010 | Tolf | A47L 15/488 134/95.2 |
| 2011/0126864 | A1 | 6/2011 | Kim | |
| 2011/0241503 | A1* | 10/2011 | Simon | F24C 15/30 312/111 |
| 2013/0203186 | A1 | 8/2013 | Tang | |
| 2014/0170954 | A1* | 6/2014 | Hintz | A47L 15/48 454/251 |
| 2014/0238450 | A1 | 8/2014 | Bertram | |
| 2014/0360534 | A1 | 12/2014 | Olson | |
| 2016/0022116 | A1 | 1/2016 | Delellis | |
| 2018/0125329 | A1 | 5/2018 | Parmeggiani | |
| 2020/0100644 | A1* | 4/2020 | Kopera | A47L 15/488 |
| 2021/0100424 | A1* | 4/2021 | Tan | A47L 15/488 |

FOREIGN PATENT DOCUMENTS

| | | | | | |
|---|---|---|---|---|---|
| DE | 19704430 | A1 | | 8/1998 | |
| EP | 0378836 | A1 | | 7/1990 | |
| EP | 0521815 | A1 | | 1/1993 | |
| EP | 2682038 | A2 | | 1/2014 | |
| EP | 3020319 | A1 | | 5/2016 | |
| EP | 3427628 | A1 | | 1/2019 | |
| JP | 2018140243 | A | | 9/2018 | |
| KR | 2013070278 | A | * | 6/2013 | A47L 15/486 |
| KR | 101308832 | B1 | | 9/2013 | |
| KR | 101685357 | B1 | | 12/2016 | |
| WO | 2013090155 | A1 | | 6/2013 | |
| WO | WO-2015107474 | A1 | * | 7/2015 | A47L 15/486 |

* cited by examiner

HOUSEHOLD DISHWASHER HAVING AT LEAST ONE AIR OUTLET

CROSS-REFERENCES TO RELATED APPLICATIONS

This application is the U.S. National Stage of International Application No. PCT/EP2021/075283, filed Sep. 15, 2021, which designated the United States and has been published as International Publication No. WO 2022/069222 A1 and which claims the priority of Chinese Patent Application, Serial No. 202011064088.5, filed Sep. 30, 2020, pursuant to 35 U.S.C. 119 (a)-(d).

The contents of International Application No. PCT/EP2021/075283 and Chinese Patent Application, Serial No. 202011064088.5 are incorporated herein by reference in their entireties as if fully set forth herein.

BACKGROUND OF THE INVENTION

The present invention relates to a household dishwasher having a dishwasher cavity in which dishes, glasses, cutlery and similar can be processed, and having at least one air outlet for blowing out dishwasher interior air of the dishwasher cavity, in particular air that is moist and/or that contains water vapor.

In such household dishwashers, it is desirable to be able to remove the items to be washed from the dishwasher cavity as completely dried as possible and without water spots.

For a good drying result of dishes, glasses, cutlery and similar items that can be processed in a dishwasher cavity, it is desirable to be able to remove dishwasher interior air that is moist and/or that contains water vapor from the dishwasher cavity. It is therefore known to connect the dishwasher cavity to an air outlet which transports dishwasher interior air that is moist and/or that contains water vapor from the dishwasher cavity to the outside environment. Such an air outlet is often located in the upper region of a front-side door or front door, which can be opened and closed. An air supply into this moving unit is therefore relatively complex and expensive. In addition, due to the high arrangement of the air outlet in the appliance, there is a risk that kitchen furniture that is located above the household dishwasher, such as for example a cabinet or countertop, will be damaged by the escaping moisture.

BRIEF SUMMARY OF THE INVENTION

The invention is based on the problem of achieving the greatest possible avoidance of moisture and/or water vapor influence on surrounding furniture while maintaining an attractive visual arrangement.

The invention solves this problem by a household dishwasher having the features of independent claims, which can be realized individually or in combination with one another. With regard to advantageous embodiments and developments of the invention, reference is made to dependent claims. By virtue of the fact that in accordance with the invention at least one air outlet is arranged in the lower quarter of the appliance height, in the event of any rise of dishwasher interior air that is moist and/or that contains water vapor and is blown out of the air outlet into the environment at the installation location of the household dishwasher in accordance with the invention, at most, in other words if at all, the household dishwasher itself is influenced by any condensed-out moisture and/or water vapor and not furniture that is arranged above the household dishwasher, such as for example a kitchen countertop. In addition, the fact that the air outlet extends as a slot outlet over at least half of the width of the household dishwasher, in particular its base support, means that a wide distribution of the escaping dishwasher interior air that is moisture-laden and/or that contains water vapor is achieved. For this purpose, the slot outlet preferably has a large slot width and a low slot height in relation to this slot width. The dishwasher interior air that flows out of the dishwasher interior of the dishwasher cavity is consequently distributed over many outlet points along the width of the slot outlet. A selectively high, in other words locally concentrated, dishwasher interior air volume flow, as would be generated in a household dishwasher with only a single air outlet having an approximately circular passage cross-sectional area at the outlet of this single air outlet, and with which a selectively high moisture entry into furniture would be associated, is avoided. In particular, the dishwasher interior air that is moist and/or that contains water vapor, which is blown out of the slot outlet that extends over at least half of the width of the household dishwasher, can be distributed so finely over a larger area outside the household dishwasher in accordance with the invention that the dishwasher interior air can mix more effectively with ambient air which is drier than the dishwasher interior air. Moisture and/or water vapor which is or are contained in the dishwasher interior air that is blown out over at least half of the width of the household dishwasher by means of the slot outlet in accordance with the invention can be absorbed by the ambient air in an improved manner. Consequently, as viewed along the width extent of the slot outlet, locally at each point of the slot outlet in each case in particular only a reduced volumetric flow of dishwasher interior air that is moist and/or that contains water vapor emerges into the environment at the installation location of the household dishwasher in comparison with a concentrated volumetric flow of dishwasher interior air that flows out of a single, for example circular, locally limited or punctiform air outlet (with the same total throughput of dishwasher interior air). The slot outlet in accordance with the invention ensures local dilution of the dishwasher interior air coming from the dishwasher interior of the dishwasher cavity and of the moisture content in the ambient air contained therein. Condensation of moisture on the front side of the household dishwasher, in particular its front door, can be reduced or even to a great extent avoided in this way. In particular, to a great extent this consequently prevents condensate droplets from combining to form larger liquid droplets, which then run or drip down from the air outlet onto the floor at the installation location of the household dishwasher. In addition, the distribution of the blown-out dishwasher cavity air over at least half of the width of the household dishwasher, in particular its front door, produced by means of the slot outlet can even make it possible for the volumetric flow of blown-out dishwasher interior air per outlet point of the outlet slot to be so low that the locally width-distributed blown-out dishwasher interior air can hardly or only insignificantly be perceived by a user of the household dishwasher along the width extension of the outlet slot.

It is expedient that the outlet cross-sectional area is smaller, in particular significantly smaller, than the inlet cross-sectional area of the air outlet in accordance with the invention. This causes an increase in the flow speed of the dishwasher interior air that is blown out of the slot outlet into the environment with respect to the flow speed of the dishwasher interior air upstream prior to entering the slot outlet. This further reduces the risk of undesirable condensate accumulation and dripping of water on the outlet side of the slot outlet.

In addition, the narrow slot outlet in the lower quarter of the appliance height of the household dishwasher in accordance with the invention is hardly noticeable optically or visually to a user who is standing in front of the household dishwasher in accordance with the invention.

In particular, the width of the slot outlet is at least two-thirds of the width of the household dishwasher in order to achieve good distribution of the moist air and mixing with the drier outside air or ambient air in the room in which the household dishwasher in accordance with the invention is housed.

Provided that the air outlet is preferably at least 40 centimeters wide overall, a particularly wide and uniform distribution of the moisture can be achieved.

In particular, the air outlet is designed as a flat slot outlet having a height to width ratio of less than 1:10, particularly advantageously of less than 1:20. Despite the structurally and visually particularly low height, a high discharge surface can thus be achieved.

For a high degree of mechanical stability and security against interference, the air outlet can be divided into several sub-slots that lie in alignment adjacent to one another, for example into two to three sub-slots that are adjacent to one another that each comprise stiffening vertical bars as a stable separation from one another.

If the air outlet is located on the front side of the household dishwasher, which is facing a user, the air that is escaping there, which is often laden with moisture and/or water vapor, can distribute itself quickly and to a great extent freely over a large area.

Visually advantageously and with minimal restriction of the available installation space, the air outlet is arranged entirely at the lower end of the front side of the household dishwasher. In particular, the air outlet is provided in the region of the lower edge of a front-side base panel of the household dishwasher in accordance with the invention. The base panel preferably covers the front side of a base support, on which the dishwasher cavity is mounted above. The base support accommodates various functional components of the household dishwasher, such as for example a circulation pump, a drain pump, a control/monitoring unit for performing various dishwashing programs, a softening unit, etc. If the front door of the household dishwasher in accordance with the invention is brought into its approximately vertical closing end position and closes the front-side loading opening of the dishwasher cavity, the front door is approximately parallel to the base panel and ends with its lower edge preferably in a higher position than the lower edge of the base panel.

Even if the air outlet itself does not occupy the full width of the appliance, it is advantageous visually and in terms of installation if the air outlet is arranged within an assembly unit that preferably extends over the entire width of the front side of the household dishwasher. Preferably, the assembly unit is arranged behind a front-side base panel of the base support of the household dishwasher, as viewed in the depth direction of the household dishwasher. In particular, it can be expedient if the assembly unit has a projection that is oriented forwards and that is arranged below the lower edge of the base panel and has the slot outlet there or forms the slot outlet together with the lower edge of the base panel.

In particular, the air outlet can be arranged within a design element that extends with a constant height over a wide area and, if necessary, can also be of contrasting color with respect to a front panel in the lower region of the household dishwasher, for example as a black element compared with a white panel or a stainless-steel decor.

A high degree of efficiency can be achieved if the air outlet can be controlled by at least one air conveying element such as a fan wheel, in other words can be supplied with dishwasher interior air from the dishwasher interior of the dishwasher cavity. The air conveying element is fluidically connected on the upstream side preferably via an air duct to at least one air outlet opening of the dishwasher cavity or to at least one air outlet opening of the inner door of the front door. An exhaust air duct preferably leads from the air conveying element on the downstream side to the air outlet. If the air conveying element is activated, in other words is switched on, dishwasher interior air is extracted from the dishwasher interior of the dishwasher cavity by the air conveying element via the air duct on the upstream side to the air conveying element and is then blown by the air conveying element through the exhaust air duct on the downstream side to the air outlet. The air conveying element can preferably be arranged in the lower region of the household dishwasher behind the air outlet in the depth direction. The fan wheel or similar can then preferably be located at approximately the same height as the air outlet itself and be arranged in the base or base support of the household dishwasher to save space. For this purpose, particularly advantageously, the air duct preferably starts within the upper 50% of the height of the dishwasher cavity in one of its walls whereby a long path for possible condensation is formed. In particular, the air duct can be at least 40 centimeters long. In addition, it is advantageous if the air duct first runs upwards from its start at the air outlet opening in the wall of the dishwasher cavity or the front door, so that any condensation that forms can run back into the dishwasher cavity and does not remain in the air duct.

Particularly advantageously, an air duct, in particular that is several tens of centimeters long, is arranged upstream of the air outlet and comes from the dishwasher cavity. A large part of the condensation can then already be distributed in this long air duct.

Particularly advantageously and separately claimed, an outlet duct extends between the at least one air conveying element and the air outlet, and the outlet duct is designed with a reduced cross-section with respect to the air duct that leads from the dishwasher cavity to the conveying element, in particular from an air outlet opening in a wall, in particular side wall, of the dishwasher cavity or in an inner door wall of the front door. Due to the reduced cross-section, the flow speed of the dishwasher interior air that is extracted from the dishwasher interior of the dishwasher cavity by means of the conveying element is increased in the outlet duct with respect to the flow speed of the dishwasher interior air in the air duct upstream of the conveying element, so that only little condensation occurs downstream of the conveying element in the vicinity of the air outlet and consequently the formation of water and the risk of water that drips from the air outlet is minimized here.

One advantageous further development of the invention provides that the fan wheel or a similar conveying element can be controlled in a clocked manner, even over a period of several days. In this case, the fan wheel can also be controlled via recording the moisture of the dishwasher cavity. The household dishwasher can then also serve as a store for dishes, glasses, cutlery and similar, and this material that is washed beforehand can also dry continually in phases over several days.

The blowing out of dishwasher interior air from the household dishwasher in accordance with the invention via its slot outlet can thus be performed not only during the drying cycle of the wash cycle of at least one dishwashing program that is to be performed, but if required additionally later in time after the end of the drying cycle of the wash cycle during one or more post-drying cycles for the post-drying of the items to be washed that are stored in the dishwasher interior. Such post-drying can be desired if the door is not opened by the user or an automatic door opening system immediately after the end of the drying cycle of the dishwashing cycle of the respective dishwashing program that is to be performed, but remains closed for a longer period of time, in particular for at least 6 hours up to several days, such as for example for up to 96 hours. This storage of items to be washed in the dishwasher interior of the dishwasher cavity with the door closed, which takes place after the end of the drying phase of a dishwashing program that has been performed, is referred to as the "storage function". In order in this case to keep the items to be washed dry in the dishwasher interior or to prevent it from rewetting, at least one air conveying element is activated from time to time for a certain period of time in each case in order to cause the items to be washed in the dishwasher interior to dry again by exchanging dishwasher interior air with ambient air or in order to a great extent to prevent rewetting of the items to be washed, and then deactivated again.

Other developments of the invention are represented in the subordinate claims.

The advantageous embodiments and developments of the invention that are explained above and/or represented in the subordinate claims can be used in this case individually or in any combination with one another—except, for example, in the case of clear dependencies or incompatible alternatives.

The invention and its advantageous embodiments and developments as well as the advantages thereof are explained in more detail below with reference to drawings that illustrate exemplary embodiments.

BRIEF DESCRIPTION OF THE DRAWINGS

A schematic sketch of the principle is shown in each case.

DETAILED DESCRIPTION OF EXEMPLARY EMBODIMENTS OF THE PRESENT INVENTION

Figure 1:
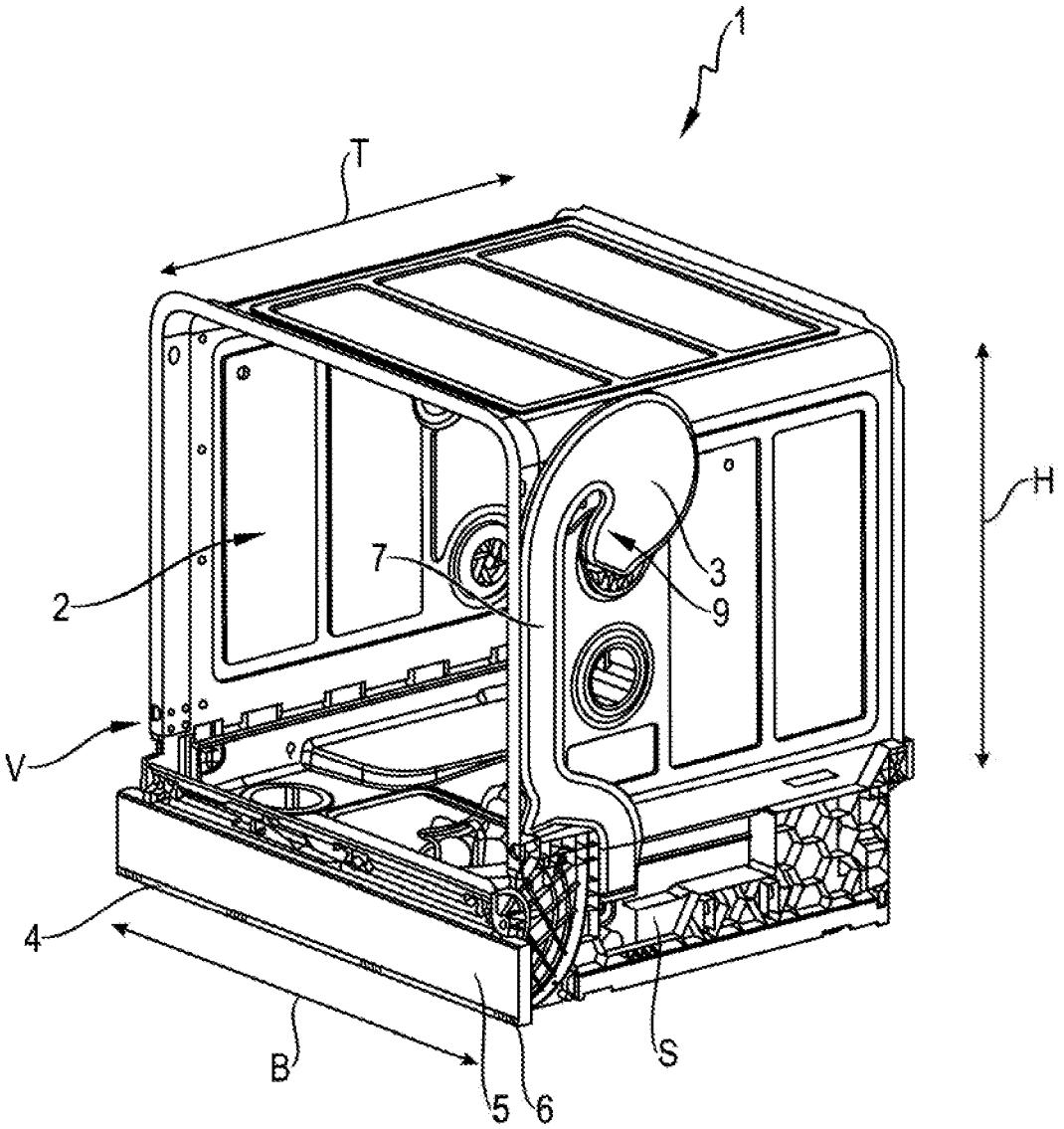
FIG. 1 shows from obliquely in front, a schematic perspective view of an advantageous embodiment of a household dishwasher that is designed in accordance with the invention, here without outer housing parts, with a view into a dishwasher cavity inside the household dishwasher.
Figure 2:
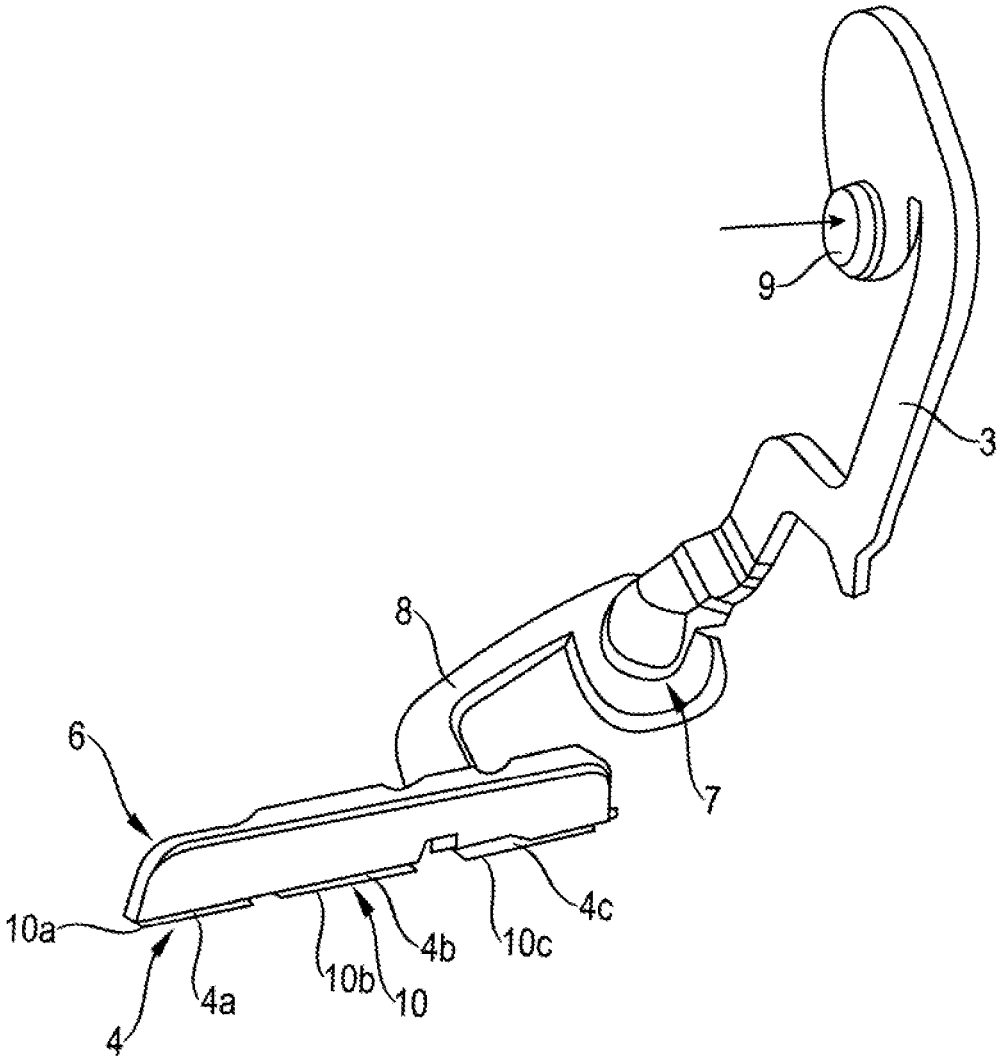
FIG. 2 shows a schematic individual part view of the air-guiding parts.

In FIGS. 1 and 2, corresponding parts are provided with the same reference characters. In this case, only those components of a household dishwasher that are necessary for understanding the invention are provided with reference characters and explained.

The household appliance that is schematically illustrated in FIG. 1 is here a household dishwasher 1. Also, other household appliances 1 having a drying function are in principle eligible for a design in accordance with the invention.

The household dishwasher 1 that is described below according to FIG. 1 has, as part of an appliance body that is partially open to the outside or closed, a dishwasher cavity 2 for receiving items to be washed, such as inter alia dishes, pots, cutlery, glasses, cooking utensils. In this case, the items to be washed can be held, for example, in racks and/or a cutlery drawer and can be influenced in this case by so-called washing liquor. In this case, washing liquor is understood to be fresh water or, in particular, water circulating during operation, with or without detergent and/or rinse aid and/or drying agent. In particular, the washing liquor has passed through an ion exchanger for softening. In addition, the washing liquor can also be more or less mixed with soiling from ongoing operation. The dishwasher cavity 2 can have an at least essentially rectangular outline with a front side V that is facing a user in the operating position. In this case, this front side V can form a part of a kitchen front of adjacent kitchen furniture or, in the case of a stand-alone appliance, can also be without reference to further furniture.

The dishwasher cavity 2 can be closed, in particular at this front side V, by a front door or flap. This is not shown here.

The household dishwasher can be designed as a stand-alone appliance or as a so-called partially integrable or also fully integrable appliance. In the latter case, the appliance body can also terminate essentially flush with the outer walls of the dishwasher cavity 2. A housing that surrounds this dishwasher cavity on the outside can then be superfluous. In the lower region of the household dishwasher, there can be a base S for accommodating, in particular, functional elements, such as also a pump for circulating the washing liquor. This circulation pump can in particular also be heated as a so-called heating pump, in order to bring the washing liquor to the temperature that is desired in the respective program step. An external heating system that is independent of the circulation pump can be provided additionally or alternatively.

In the width direction B, the household dishwasher often has an extent of 45, 50 or 60 centimeters. In the depth direction T from the front side V to the rear, the extent is likewise often about 60 centimeters. The values are not mandatory. In particular, an easily accessible installation, for example at eye level or at the height of a worktop, is also possible. The lower edge of the household dishwasher 1 is then approximately 70 to 110 centimeters above the floor in the installation position.

The household dishwasher 1 is provided with at least one air outlet 4 for blowing out, in particular, moist air from the dishwasher cavity 2 in which dishes, glasses, cutlery and similar can be processed. This air outlet is arranged in the lower region, namely in the lower quarter, of the appliance height H and extends as a horizontal slot outlet over at least half of the width B of the household dishwasher 1. In this way, a good distribution of the blown-out air is achieved, so that even in the case of particularly moist air which is to be conveyed to the outside, condensation and droplet formation in the region of the air outlet 4 can be avoided to the greatest possible extent. In particular, it is thus also possible to form the air outlet 4 entirely at the lower end of the front side—almost as a lower edge—of the household dishwasher 1 without drops running from there onto the kitchen floor or onto cabinets that are arranged below.

In particular, the single-piece or multi-piece air outlet 4 is at least 40 centimeters wide overall for this purpose. In accordance with FIG. 1, the air outlet is designed in this case as a flat slot outlet, wherein its height to width ratio can be less than 1:10, in particular also less than 1:20. Then, with a 40-centimeter-wide air outlet 4, its height in the height direction H is less than approximately 2 centimeters.

As already indicated above, the air outlet 4 can be divided into several sub-slots 4*a*, 4*b*, 4*c* that lie in alignment adjacent to one another, as indicated in FIG. 2. These do not all have to be of the same length. It is important that a broadly extended air outlet 4 is created overall, which allows a high air throughput in order to also achieve a broad distribution of the moisture that is contained in the air.

Here, as an example, two to three sub-slots 4*a*, 4*b*, 4*c* are provided adjacent to one another and the sub-slots extend in each case with a small height approximately 8 to 15 centimeters in the direction of the width B of the household dishwasher 1.

Further, it can be seen from FIG. 1 that the air outlet 4 is arranged on the front side V of the household dishwasher 1, which is facing a user, so that the air outlet blows out into the free air space in front of the household dishwasher 1 and the moist air does not disappear inside built-in furniture where it could cause damage.

Both for the assembly as well as for the design, it is advantageous if, as can be seen for example in FIG. 1, the air outlet 4 is arranged within an assembly unit 6 that extends over the entire width B of the front side V of the household dishwasher 1 and can thus have the same continuous width as, for example, a base panel 5 that is arranged above the air outlet on the front side. This gives a particularly uniform and uncluttered design and consequently a pleasing appearance.

In the exemplary embodiment, the assembly unit 6 is thus preferably arranged behind a front-side base panel 5 of the base support or base S of the household dishwasher 1, as viewed in the depth direction. The assembly unit has a projection 10 that is oriented forwards and that comprises the partial sections 10*a*, 10*b*, 10*c* and the projection is arranged below the lower edge of the base panel 5 and has the slot outlet 4 there comprising the sub-slots 4*a*, 4*b*, 4*c* or forms the slot outlet together with the lower edge of the base panel 5.

In particular, the assembly unit 6 can be designed as a design element that extends continuously over the horizontal course of the assembly unit with the same height extension, so that the air outlet 4 is then arranged within a design element that extends with a constant height over a wide area. This can be designed, for example, from metal or also as a whole as a plastic unit, in particular as an injection-molded part in which the respective sub-slots 4*a*, 4*b*, 4*c* are recessed. Of course, other materials are also possible. If necessary, the front-mounted base panel 5 can be omitted. In this case, the assembly unit 6 itself can be expediently designed as a decorative base panel and can integrally comprise the slot-like air outlet 4.

The design element can be of contrasting color with respect to a front panel 5 in the lower region of the household dishwasher 1, for example black or chrome-plated or with a brushed stainless-steel look. Other designs are of course also possible.

To enable air, in particular also moist air, to be conveyed out of the dishwasher cavity 2, an air duct 3 that is several tens of centimeters long and that comes from the dishwasher cavity 2 is arranged upstream of the air outlet 4. This air duct 3 starts far up in the dishwasher cavity 2, in particular at least within the upper 50% of the height H of the dishwasher cavity 2 in one of the walls of the dishwasher cavity. Particularly advantageously for the rising water vapor, a start 9 is provided in the upper 50%, in particular 30%, of the height of the dishwasher cavity 2. Here, the start 9 of the air duct 3 is provided in a side wall. According to the drawing, the air duct 3 extends from its start 9 in the wall of the dishwasher cavity 2 initially in a kind of loop upwards, so that any condensation that forms can run back into the dishwasher cavity 2 and does not remain in the air duct 3.

From its start 9 at the dishwasher cavity 2, the air duct 3 extends into the base S towards at least one conveying element 7, such as a fan wheel. According to the drawing, the air duct 3 is at least 40 centimeters long and can thus bridge approximately the entire height H of the household dishwasher 1. The air duct 3 can be manufactured as a plastic assembly unit, in particular of uniform material.

The fan wheel or similar conveying element 7 can be arranged in the base S of the household dishwasher, in other words in its lower region, in the depth direction T behind the air outlet 4 and at approximately the same height as the air outlet. In particular, the conveying element 7 is arranged at the lowest point of the household dishwasher 1 directly above its base.

However, in this case an outlet duct 8 extends between the conveying element 7 and the slot-shaped air outlet 4 and the outlet duct has a reduced cross-section with respect to the air duct 4 that leads to the conveying element 7. In particular, the cross section is reduced by at least 15%. At the same air throughput, the flow speed in the outlet duct 8 is consequently significantly increased with respect to the air duct 4, so that condensation and drop formation hardly occur in this outlet duct 8. This also helps to keep condensation and liquid water to a minimum at the air outlet 4. Together with the wide air outlet 4 and the large distribution area that is consequently achieved, this goal is achieved in a particularly effective and optimized manner. The low height of the air outlet 4 also results in a small cross-section despite the large width. This means that a high flow speed of the air is also necessary here, so that the risk of condensation directly at the air outlet 4 is also low. Corresponding baffles or similar devices can be provided in the air outlet 4 to achieve a uniformly and widely distributed air flow. These can be an integral part of the assembly unit 6.

In particular, the discharge duct also does not run diagonally downwards, but horizontally, so that any water that does occur does not reach the air outlet 4 and could drip out the air outlet.

Such a household dishwasher 1 can also be well equipped with a so-called storage function, which allows the items to be washed to remain in the dishwasher cavity 2 with the front door closed after processing, without becoming damp again. The items to be washed can remain in the dishwasher cavity for several days without the dryness of the items to be washed deteriorating. The household dishwasher 1 then also serves as a storage and drying cabinet from which the items to be washed can be removed fresh and dry.

For this purpose, the conveying element 7 in particular can be controlled in a clocked manner. Alternatively and particularly effectively, the conveying element 7 is controlled via a moisture sensor system which provides a measure of the current moisture of the items to be washed in the dishwasher cavity.

In both cases, the conveying element 7 is only switched on from time to time in order to repeatedly convey moist air out of the dishwasher cavity 2 and thus to maintain the quality of the cleaning of the items to be washed over a longer period of time. Due to the only short effective running times, the energy requirement is low—as is the noise pollution caused by the at least one fan wheel or similar conveying element 7.

Overall, the invention significantly reduces the risk of condensation at the air outlet 4.

LIST OF REFERENCE CHARACTERS

1 Household appliance,
2 Dishwasher cavity,
3 Air duct,
4 Air outlet,
5 Base panel,
6 Assembly unit,
7 Conveying element,
8 Outlet duct,
9 Start of the air duct at the dishwasher cavity,
V Front side,
B Width,
T Depth direction,
H Height,
S Base

The invention claimed is:

1. A household dishwasher, comprising:
a dishwasher cavity for processing items to be washed;
a front-side base panel located at a lower end of and extending over a width of a front side of the household dishwasher;
an assembly unit arranged behind the front-side base panel and extending over the width of the front side of the household dishwasher; and
an air outlet arranged within the assembly unit and extending over at least half of the width of the front side of the household dishwasher, the air outlet designed to blow out dishwasher interior air of the dishwasher cavity and configured as a slot outlet having a lower boundary and an upper boundary, the lower boundary comprising a projection that extends forward from the assembly unit and below the base panel, the upper boundary comprising a lower edge of the base panel.

2. The household dishwasher of claim 1, wherein the air outlet is at least 40 centimeters wide overall.

3. The household dishwasher of claim 1, wherein the air outlet is designed as a flat slot outlet having a height to width ratio of less than 1:10.

4. The household dishwasher of claim 1, wherein the air outlet is designed as a flat slot outlet having a height to width ratio of less than 1:20.

5. The household dishwasher of claim 1, wherein the air outlet is divided into several sub-slots that lie in alignment adjacent to one another.

6. The household dishwasher of claim 5, wherein two to three of the several sub-slots are provided adjacent to one another.

7. The household dishwasher of claim 1, wherein a front door arranged on a user-facing front side of the household dishwasher, when in a vertical closing end position configured to close a front-side loading opening of the dishwasher cavity, is approximately parallel to the base panel and ends with a lower edge of the front door in a higher position than the lower edge of the base panel.

8. The household dishwasher of claim 1, wherein an outlet cross-sectional area of the air outlet is smaller than an inlet cross-sectional area of the air outlet.

9. The household dishwasher of claim 1, wherein the front-side base panel and the assembly unit extend over an entire width of the front side of the household dishwasher.

10. The household dishwasher of claim 1, wherein the air outlet extends over an entire width of the front side of the household dishwasher.

11. The household dishwasher of claim 1, further comprising a base support residing rearward of the front-side base panel and below the dishwasher cavity, the assembly unit arranged behind the front-side base panel and in front of the base support, as viewed in a depth direction.

12. The household dishwasher of claim 1, wherein baffles are located in the air outlet to facilitate an airflow from the air outlet that is uniformly distributed over a width of the air outlet.

13. The household dishwasher of claim 1, wherein the assembly unit is configured as a design element that extends continuously and with a constant height over a horizontal course of the assembly unit such that the air outlet is arranged within the design element.

14. The household dishwasher of claim 13, wherein the design element is of contrasting color with respect to the front-side base panel.

15. A household dishwasher, comprising:
a dishwasher cavity having a dishwasher interior for processing items to be washed;
a front-side base panel located at a lower end of and extending over a width of a front side of the household dishwasher;
an assembly unit arranged behind the front-side base panel and extending over the width of the front side of the household dishwasher;
an air outlet arranged within the assembly unit and extending over at least half of the width of the front side of the household dishwasher, the air outlet designed to blow out dishwasher interior air of the dishwasher cavity and having a lower boundary and an upper boundary, the lower boundary comprising a projection that extends forward from the assembly unit and below the base panel, the upper boundary comprising a lower edge of the base panel;
a conveying element responsible for blowing out the dishwasher interior air;
an air duct leading from the dishwasher cavity to the conveying element; and
an outlet duct extending between the conveying element and the air outlet, said outlet duct designed with a reduced cross-section with respect to the air duct.

16. The household dishwasher of claim 15, wherein the air duct is several tens of centimeters long, said air duct extending from the dishwasher cavity and arranged upstream of the air outlet.

17. The household dishwasher of claim 15, wherein the conveying element is a fan wheel to influence the air outlet with dishwasher interior air from the dishwasher interior of the dishwasher cavity, said conveying element arranged in a lower region of the household dishwasher behind the air outlet in a depth direction.

18. The household dishwasher of claim 15, wherein the dishwasher cavity is defined by walls, said air duct starting within an upper 20% of a height of the dishwasher cavity in one of the walls.

19. The household dishwasher of claim 15, wherein the air duct is at least 40 centimeters long.

20. The household dishwasher of claim 15, wherein the conveying element is controllable in a clocked manner over a period of several days.

21. The household dishwasher of claim 15, wherein the conveying element is controllable by detecting moisture in the dishwasher cavity.

* * * * *